US008462172B2

(12) United States Patent
Matsubara

(10) Patent No.: US 8,462,172 B2
(45) Date of Patent: Jun. 11, 2013

(54) VIDEO DISPLAY APPARATUS AND VIDEO DISPLAY METHOD

(75) Inventor: Shogo Matsubara, Musashino (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 304 days.

(21) Appl. No.: 12/862,445

(22) Filed: Aug. 24, 2010

(65) Prior Publication Data

US 2011/0057945 A1 Mar. 10, 2011

(30) Foreign Application Priority Data

Sep. 10, 2009 (JP) ..... 2009-209088

(51) Int. Cl.
*G09G 5/02* (2006.01)
*G09G 3/36* (2006.01)
*G09G 5/10* (2006.01)

(52) U.S. Cl.
USPC ..... 345/589; 345/102; 345/690

(58) Field of Classification Search
USPC ..... 345/589, 102
See application file for complete search history.

(56) References Cited

U.S. PATENT DOCUMENTS 8,139,020 B2 * 3/2012 Ohshima ..... 345/102
2001/0054996 A1 * 12/2001 Naka et al. ..... 345/72

FOREIGN PATENT DOCUMENTS

| | | | |
|---|---|---|---|
| JP | 2001-027890 | | 1/2001 |
| JP | 3215388 | A | 1/2001 |
| JP | 3602520 | A | 4/2004 |
| JP | 2004191490 | A | 7/2004 |
| JP | 2005-070656 | | 3/2005 |
| JP | 2006208581 | A | 8/2006 |
| JP | 2007-272023 | | 10/2007 |
| JP | 2009-181075 | | 8/2009 |
| WO | WO-2008-126904 | | 10/2008 |

* cited by examiner

*Primary Examiner* — Ulka Chauhan
*Assistant Examiner* — Sae Won Yoon
(74) *Attorney, Agent, or Firm* — Patterson & Sheridan, LLP

(57) ABSTRACT

A video display apparatus includes: an area-specific lighting value calculator configured to calculate a lighting value of each of divided light source regions of a backlight and output the lighting value as numerical data; a signal output module configured to output a video signal correlated with the lighting value to a display module; a backlight controller configured to control the backlight based on the lighting value; a correction gain setting module configured to obtain a signal correction coefficient; a frequency separator configured to separate the input video signal; a signal corrector configured to correct the lighting value with respect to a low frequency component or DC component separated from the input video signal to suppress amplification of noise contained in a dark portion and generate an output video signal; and a display controller configured to control the display module to display the output video signal.

18 Claims, 6 Drawing Sheets

VIDEO DISPLAY APPARATUS AND VIDEO DISPLAY METHOD

CROSS REFERENCE TO RELATED APPLICATION(S)

The present disclosure relates to the subject matters contained in Japanese Patent Application No. 2009-209088 filed on Sep. 10, 2009, which are incorporated herein by reference in its entirety.

BACKGROUND

1. Field

The present invention relates to a video display apparatus and a video display method.

2. Description of the Related Art

In liquid crystal display for adaptively controlling a light source of a backlight in accordance with an input video signal, the input signal is adaptively corrected in accordance with the calculated lighting value of each light source region to give a correlation between the lighting value and the transmittance of liquid crystal to thereby dynamically control luminance to take a proper luminance value. For example, a technique described in JP-A-2004-191490 provides a liquid crystal display device for performing area control by dividing a light source to correct luminance to a desired luminance value by multiplying an input signal by a correction value based on a lighting value calculated from the input signal. The technique is an example of backlight area control. There was however a problem that a noise component contained in a dark portion of a video signal was enlarged to disturb viewing because there was a tendency for a correction gain to increase in a region of a dark portion.

BRIEF DESCRIPTION OF THE DRAWINGS

A general configuration that implements the various feature of the invention will be described with reference to the drawings. The drawings and the associated descriptions are provided to illustrate embodiments of the invention and not to limit the scope of the invention.

DETAILED DESCRIPTION OF THE EMBODIMENTS

Embodiments of the invention will be described below.

A first embodiment of the invention will be described with reference to the drawings.

Figure 7:
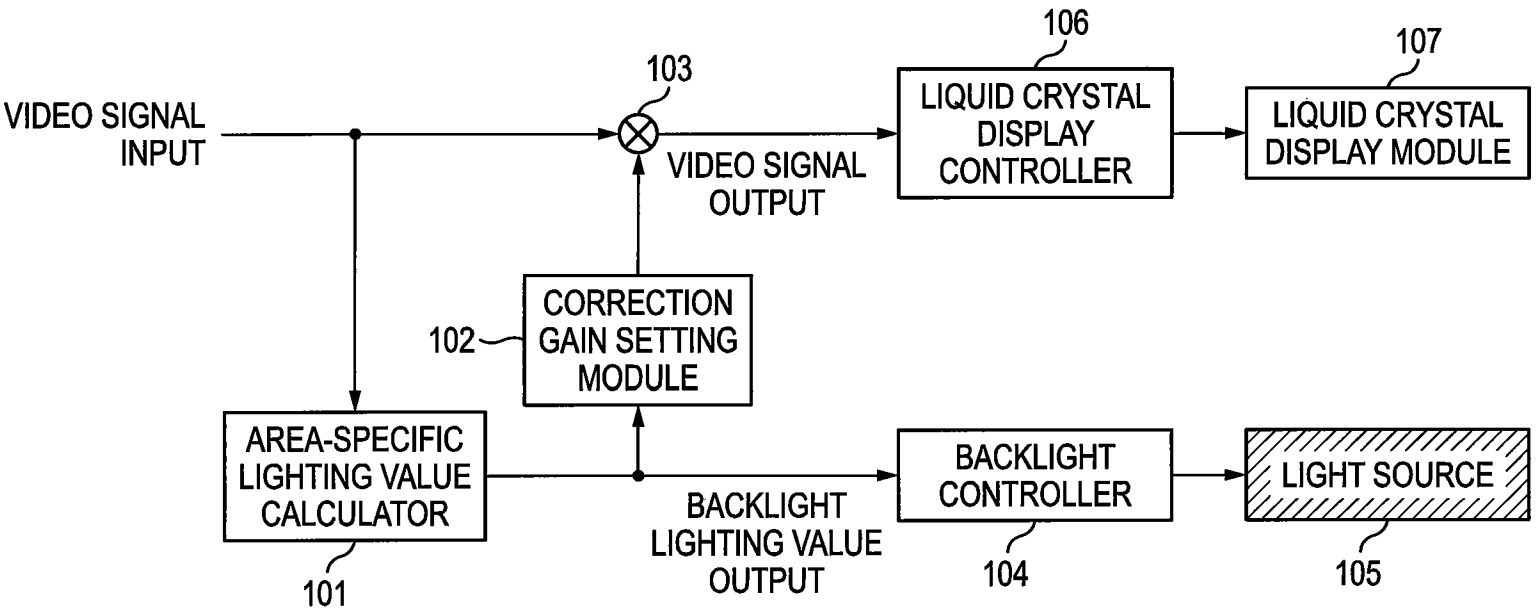
FIG. 7 is an example of a liquid crystal display device according to the background art.

A conventional liquid crystal display device according to a related-art will be described first. As shown in FIG. 7, the liquid crystal display device includes a liquid crystal display controller 106 for controlling a liquid crystal display panel, a liquid crystal display module 107, an area-specific lighting value calculator 101 for calculating a lighting value while adjusting an input video signal to each divided light source region, a correction gain setting module 102 for obtaining a signal correction coefficient by calculating a lighting state of a backlight based on the lighting value, a multiplier module 103 for generating a video signal output by correcting the input video signal based on the signal correction coefficient, a backlight controller 104 for controlling the backlight, and a light source 105 which serves as the backlight.

The operation of the liquid crystal display device will be described next. A video signal is input to the area-specific lighting value calculator 101 for calculating a lighting value in accordance with each divided region of the light source. The lighting value of each region calculated by the area-specific lighting value calculator 101 is input to the correction gain setting module 102. On this occasion, the correction gain setting module 102 sets a correction gain while giving a correlation between the input video signal and the lighting value. A video signal corrected by the multiplier module 103 based on the correction gain output from the correction gain setting module 102 is input to the liquid crystal display controller 106, so that the liquid crystal display controller 106 controls the liquid crystal display module 107 based on the input video signal. On the other hand, the lighting value obtained by the area-specific lighting value calculator 101 is input to the backlight controller 104, so that the backlight controller 104 controls the light source 105 of the backlight. This control is performed so that light is emitted from the light source of the backlight in strict accordance with display on the liquid crystal display module.

In the liquid crystal display device, high-contrast video display can be implemented by adaptive control of the light source of the backlight in accordance with the input video signal, and luminance can be dynamically controlled to take a proper luminance value while giving a correlation between the lighting value and the transmittance of liquid crystal by adaptive correction of the input signal in accordance with the calculated lighting value of each region.

Figure 8B:
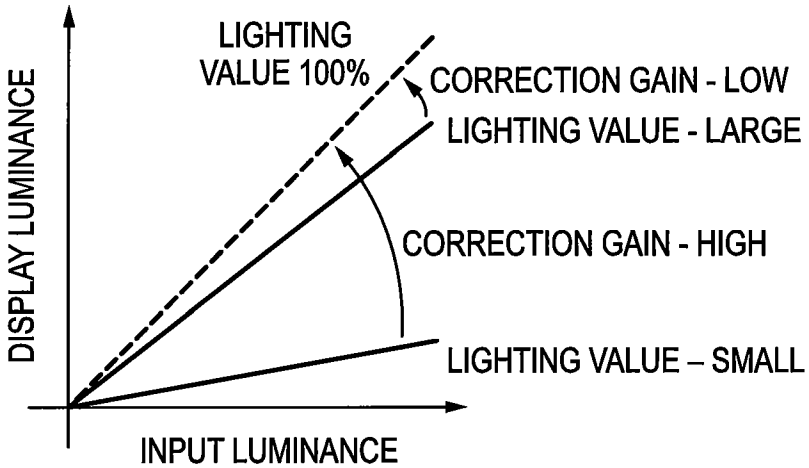
FIGS. 8A and 8B are diagrams exemplary showing a problem in the liquid crystal display device according to the background art.
Figure 8A:
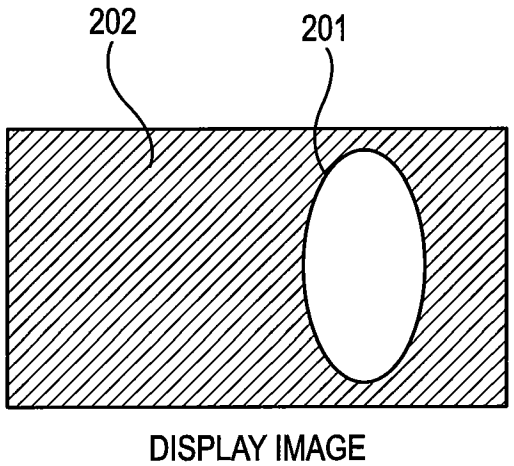

A problem in the conventional liquid crystal display device will be described next. A display image shown in FIG. 8A has a bright portion 201 and a dark portion 202. When a divided region allocated for calculating a certain lighting value is included in the dark portion 202 so that luminance in the region is lowered as a whole, the lighting value having correlation with the luminance is calculated as a small value. Consequently, as shown in a graph of FIG. 8B, the correction gain calculated by the correction gain setting module 102 trends toward increase in order to express a proper luminance value. On this occasion, when the video signal is corrected based on the set correction gain, there is a possibility that a noise component contained in the dark portion of the video signal will be enlarged to disturb viewing.

Figure 1:
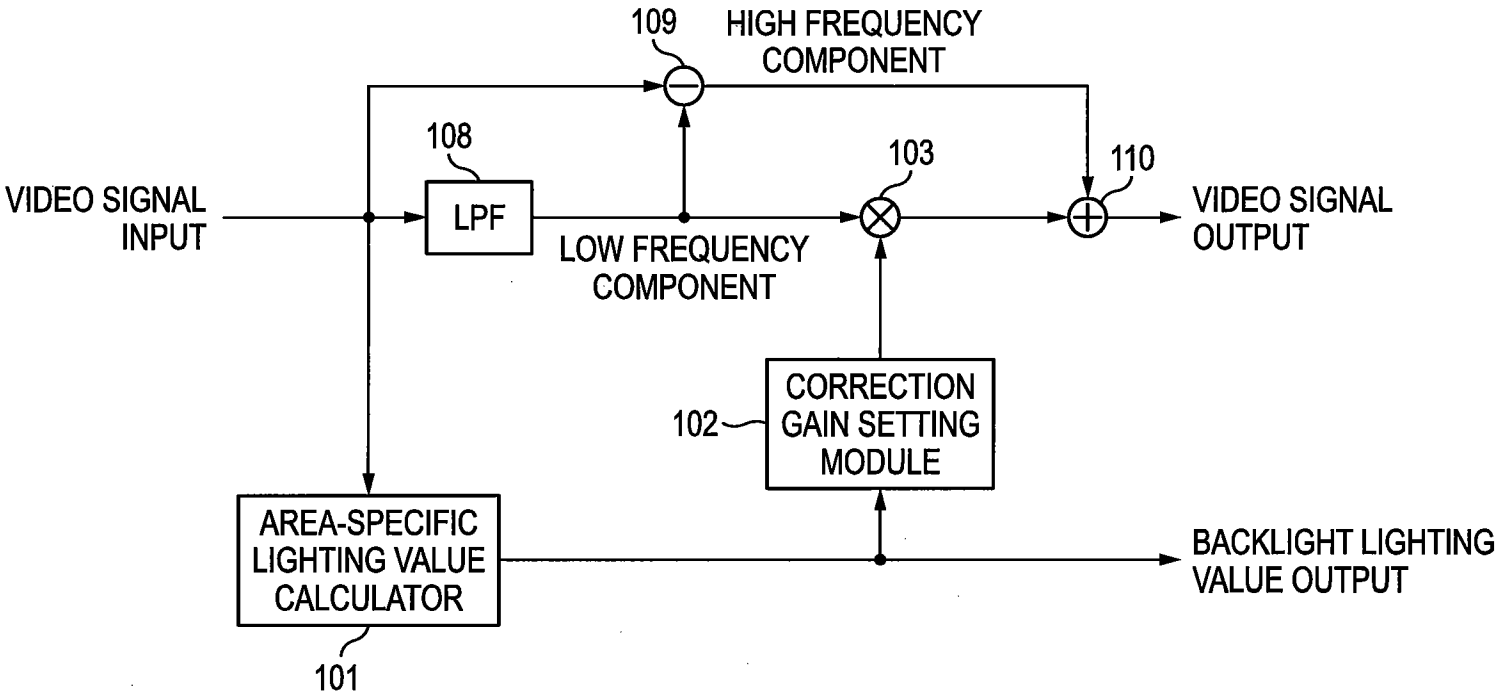
FIG. 1 is a block configuration diagram exemplary showing an image processing device according to a first embodiment of the invention.

FIG. 1 shows the first embodiment of an image processing device to solve the problem. An input video signal is input to an LPF (low-pass filter) 108 so that a low frequency component is extracted in accordance with each area. On the other hand, a low frequency component is removed from the input video signal. In this manner, the video signal is separated into a low frequency component and a high frequency component. The first embodiment is characterized in that the separated low frequency component of the video signal is corrected based on a correction gain output from a correction gain setting module 102. On this occasion, because the video signal is separated into a high frequency component containing a large noise component and a low frequency component so that only the low frequency component is corrected, luminance can be controlled to take a proper luminance value while giving a correlation between the lighting value and the transmittance of liquid crystal and enlargement of the noise component described in the aforementioned problem can be prevented.

A second embodiment of the invention will be described with reference to the drawings.

Figure 2:
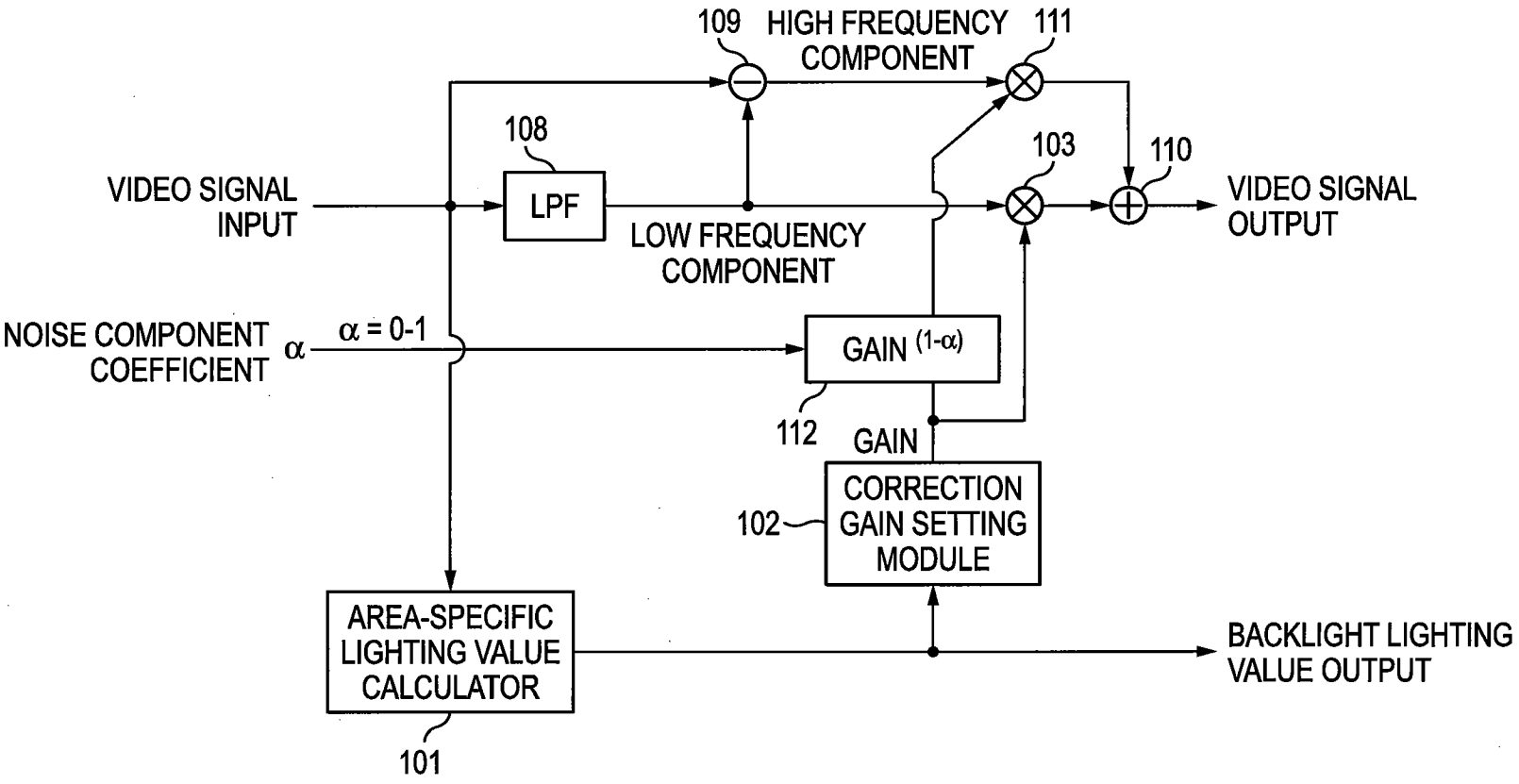
FIG. 2 is a block configuration diagram exemplary showing an image processing device according to a second embodiment of the invention.

FIG. 2 shows the second embodiment of the image processing device. In addition to the first embodiment, correction 111 based on the correction gain output from the correction gain setting module 102 can be applied also to the high frequency component side. Incidentally, a noise component coefficient $\alpha$ ($0 \leqq \alpha \leqq 1$) is input newly so that the high frequency component side correction gain is controlled in accordance with the following equation:

$$\text{High Frequency Component Side Correction Gain} = \text{Gain}^{(1-\alpha)} \text{(in which } \alpha \text{ satisfies } 0 \leqq \alpha \leqq 1)$$

This shows that the quantity of noise in a screen decreases as the noise component coefficient $\alpha$ approaches zero, and that the quantity of noise in a screen increases as the noise component coefficient $\alpha$ approaches 1. The second embodiment is characterized in that the high frequency component side correction gain becomes equal to the low frequency component side correction gain when $\alpha=0$, and that the high frequency component side correction gain becomes equal to 1, that is, no correction is made when $\alpha=1$. On this occasion, the correction gain for the high frequency component can be controlled in accordance with the quantity of the noise component so that enlargement of the noise component can be prevented when an image contains a large quantity of the noise component, and that the texture of a dark portion can be reproduced in stricter accordance with the low frequency component when an image contains a small quantity of the noise component.

Figure 4:
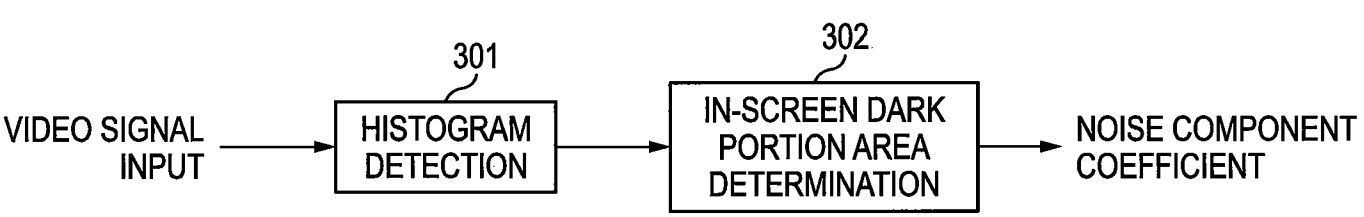
FIG. 4 is a first example of a noise component coefficient calculator used in the second and third embodiments.

FIG. 4 shows a first example of the noise component coefficient $\alpha$ calculator used in the second embodiment and a next embodiment. A video signal given in the second and third embodiments is input to a histogram detection module 301, so that a histogram in a screen is detected. The detected histogram is input to an in-screen dark area determination module 302. When the histogram shows that a low luminance portion occupies a large part of the screen, the in-screen dark area determination module 302 determines the noise component coefficient by regarding the quantity of noise in a dark portion as being large because there was a high possibility that noise would appear in the dark portion when a dark scene was taken with a camera.

The third embodiment of the invention will be described with reference to the drawings.

Figure 3:
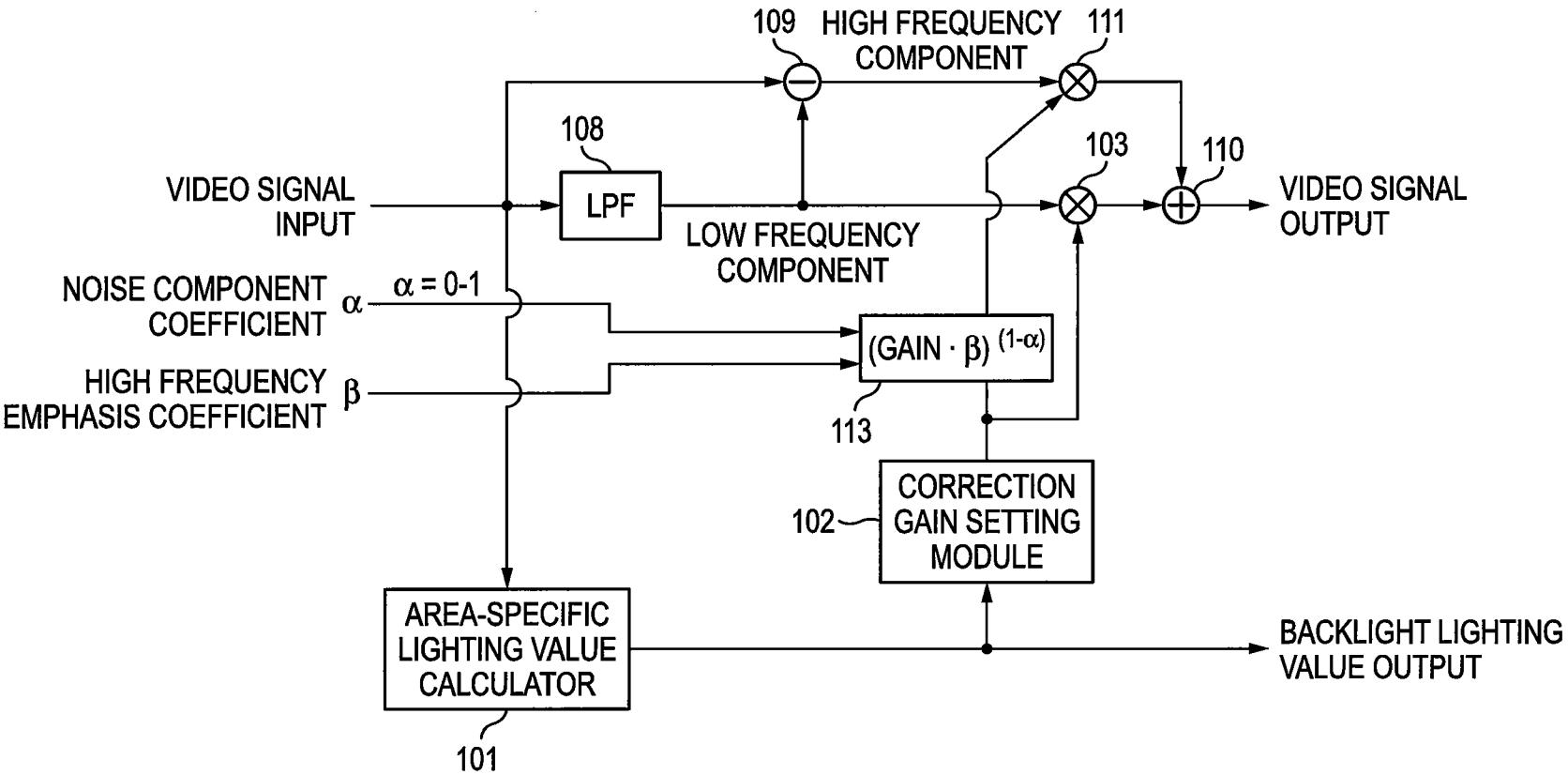
FIG. 3 is a block configuration diagram exemplary showing an image processing device according to a third embodiment of the invention.

FIG. 3 shows the third embodiment of the image processing device. In addition to the second embodiment, a high frequency emphasis coefficient $\beta$ is also input so that the correction gain is controlled in accordance with the following equation:

$$\text{High Frequency Component Side Correction Gain} = (\beta \times \text{Gain})^{(1-\alpha)} \text{(in which } \alpha \text{ satisfies } 0 \leqq \alpha \leqq 1)$$

The third embodiment is characterized in that the high frequency component side correction gain increases as the value of the high frequency emphasis coefficient $\beta$ increases, that the high frequency component side correction gain is $\beta$ times as much as the low frequency component side correction gain when the noise component coefficient $\alpha$ is equal to zero, and that the high frequency component side correction gain becomes equal to 1, that is, no correction is made when $\alpha=1$. On this occasion, the correction gain for the high frequency component can be controlled in accordance with the quantity of the noise component so that enlargement of the noise component can be prevented when an image contains a large quantity of the noise component, and that an image with clearer texture of a dark portion can be generated when the image contains a small quantity of the noise component.

The high frequency emphasis coefficient $\beta$ may be provided so that a user can set the high frequency emphasis coefficient $\beta$ (change the existing value) interactively by using a remote controller and a menu displayed on a TV screen.

Figure 5:
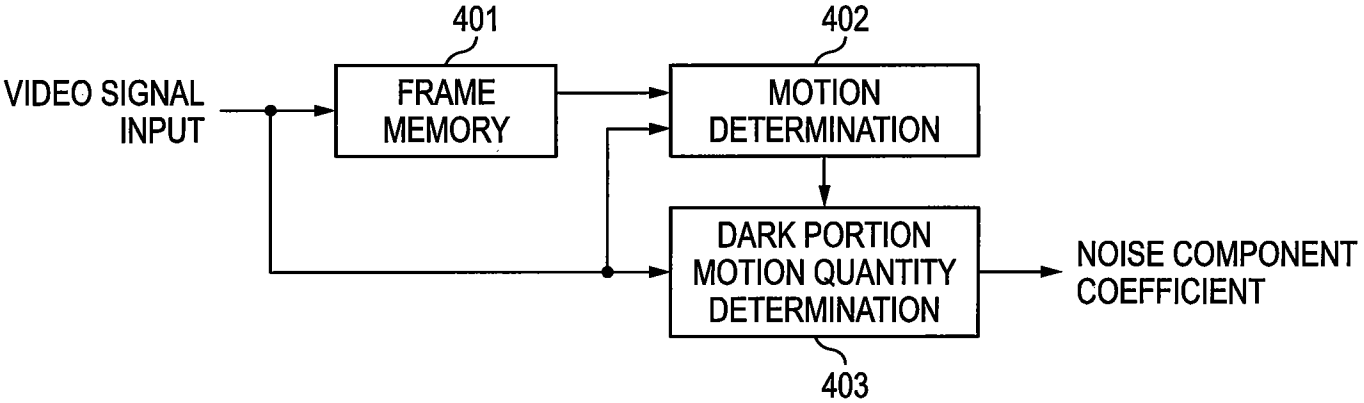
FIG. 5 is a second example of the noise component coefficient calculator used in the second and third embodiments.

FIG. 5 shows a second example of the noise component coefficient $\alpha$ calculator used in the previous the second embodiment and the third embodiment. A video signal given in the previous the second embodiment and the third embodiment is input to a frame memory 401, so that a video signal delayed for one frame is generated. The current input signal and the frame-delayed signal are input to a motion determination module 402, so that motion information is detected. Then, the detected motion information and the input video signal are input to a dark portion motion quantity determination module 403. On this occasion, the noise component coefficient in a dark portion provided as a still image is determined while the quantity of noise is regarded as being large because noise is apt to be conspicuous in such a dark portion.

Figure 6:
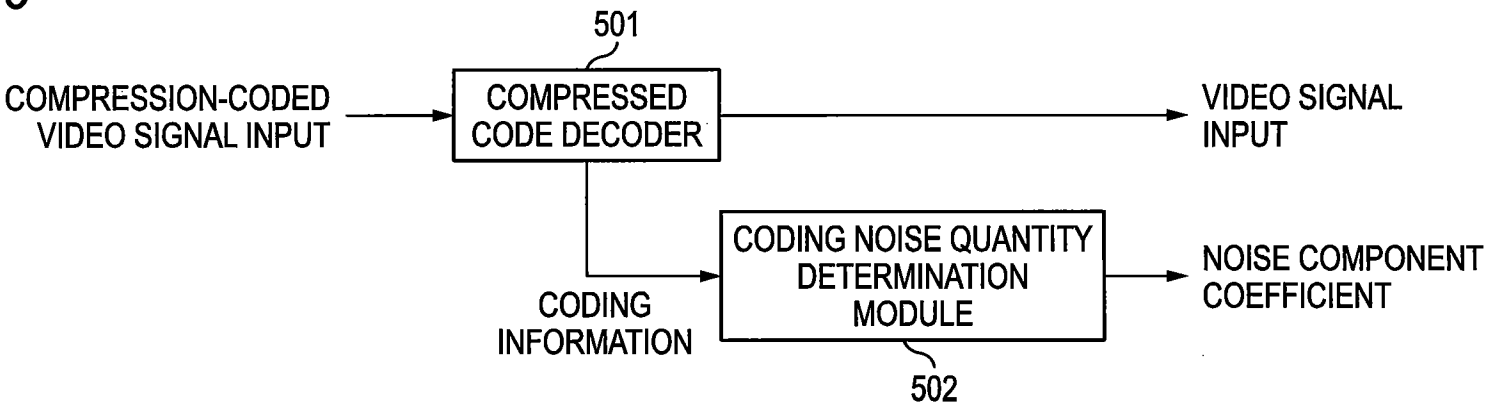
FIG. 6 is a third example of the noise component coefficient calculator used in the second and third embodiments.

FIG. 6 shows a third example of the noise component coefficient $\alpha$ calculator used in the previous the second embodiment and the third embodiment. When an input video signal given in the previous the second embodiment or the third embodiment is a video signal obtained by expansion of a compression-coded signal by a decoder, there is a possibility that coding noise such as block noise, mosquito noise, etc. will appear largely in accordance with the compression ratio. Therefore, a compressed code decoder 501 is provided as a pre-stage in the liquid crystal display device according to the second embodiment or the third embodiment, so that coding information obtained by the compressed code decoder 501 is input to a coding noise quantity determination module 502. For example, the noise component coefficient is determined on the assumption that the quantity of coding noise increases as the quantization scale value increases.

The frequency separation method in the aforementioned embodiments can be extended to frequency separation of video signal components containing no noise component in accordance with the characteristic of the input video signal.

As a technique relevant to the first embodiment has been described with reference to FIG. 7 which shows the configuration of the background art, in liquid crystal display in which a light source of a backlight is adaptively controlled in accordance with the input video signal, the input signal can be adaptively corrected based on the calculated lighting value of each region to give a correlation between the lighting value and the transmittance of liquid crystal to thereby dynamically control luminance to take a proper luminance value but the correction gain in a region of a dark portion has a tendency toward increase to enlarge the noise component contained in the dark portion of the video signal to thereby bring a possibility that enlargement of the noise component will disturb viewing.

Therefore, in the configuration of each embodiment, a frequency component containing a large quantity of the noise component can be separated and only a noise-free frequency component can be corrected to control luminance to take a proper luminance value while giving a correlation between the lighting value and the transmittance of liquid crystal to thereby prevent enlargement of the noise component described above in the problem.

There has been described a video display apparatus which is provided with a backlight having a light source divided into a plurality of regions and which outputs a video signal correlated with a lighting value of each divided light source region to a panel as a display module, the video display apparatus including: an area-specific lighting value calculator which calculates the lighting value of each divided light source region based on an input video signal; a backlight controller which controls each divided light source region of the backlight based on the lighting value; a correction gain setting module which obtains a signal correction coefficient by calculating a lighting state of the backlight based on the lighting value; a module which generates an output video signal by correcting the input video signal based on the signal correction coefficient; and a display controller which controls the panel as the display module to display the output video signal in such a manner that the output video signal is output to the panel as the display module in strict accordance with lighting of the backlight.

In the aforementioned embodiments, a signal without any noise component is corrected in order to suppress the influence of noise in a dark portion. Because a frequency component containing a large quantity of the noise component is separated so that only a noise-free frequency component is corrected, there are effects that luminance can be controlled to take a proper luminance value while giving a correlation between the lighting value and the transmittance of liquid crystal and enlargement of the noise component described in the problem can be prevented.

Incidentally, the invention is not limited to the aforementioned embodiments and may be modified variously and put into practical use without departing from the gist of the invention. For example, the invention is useful for other transmission type panel displays than the liquid crystal display.

Moreover, constituent members disclosed in the aforementioned embodiments can be combined suitably to form various inventions. For example, some constituent members may be removed from all constituent members disclosed in any one of the embodiments. In addition, constituent members disclosed in different ones of the embodiments may be combined suitably.

What is claimed is:

1. A video display apparatus comprising:

an area-specific lighting value calculator configured to calculate a lighting value for each of backlight regions based on an input video signal and to output the lighting values as numerical data;

a first correction gain setting module configured to set a first signal correction coefficient based on the lighting values;

a frequency separator configured to separate the input video signal into a first and a second component based on frequency;

a first signal corrector configured to correct the first component of the input video signal by multiplying the first component by the first signal correction coefficient;

a second correction gain setting module configured to set a second signal correction coefficient based on a quantity of noise in the input video signal, such that an increase in the quantity of noise decreases the second signal correction coefficient, and a decrease in the quantity of noise increases the second signal correction coefficient;

a second signal corrector configured to correct the second component of the input video signal by multiplying the second component by the second signal correction coefficient; and a display controller configured to control a display module to display the corrected components of the input video signal.

2. The video display apparatus according to claim 1, wherein a high frequency emphasis coefficient is input to the second correction gain setting module, and the second correction gain setting module is further configured to set the second signal correction coefficient based on the high frequency emphasis coefficient.

3. The video display apparatus according to claim 1, wherein the input video signal is a video signal obtained by expanding a compression-coded video signal.

4. The video display apparatus according to claim 3, further comprising:

a compressed code decoder configured to decode a compressed video signal to generate the input video signal and to provide information about a compression ratio of the compressed video signal; and a noise component coefficient calculator configured to calculate a noise component coefficient correlated to the quantity of noise in the dark portion of the input video signal, the noise component coefficient calculator including a coding noise determination module configured to determine the quantity of noise in a dark portion of the input video signal based on information about the compression ratio.

5. The video display apparatus according to claim 1, further comprising:

the backlight; and the display module.

6. The video display apparatus according to claim 1, further comprising:

a noise component coefficient calculator configured to calculate a noise component coefficient correlated to the quantity of noise in a dark portion of the input video signal.

7. The video display apparatus according to claim 6, wherein the noise component coefficient calculator comprises:

a histogram detection module configured to generate a histogram based on the input video signal, the histogram correlating luminance values with a percentage of a display screen occupied by each luminance value;

a dark area determination module configured to determine the quantity of noise in the dark portion of the input video signal based on the histogram.

8. The video display apparatus according to claim 6, wherein the noise component coefficient calculator comprises:

a video frame memory module configured to generate a frame-delayed video signal from the input video, the frame-delayed video signal corresponding to a previous frame of the input video signal;

a motion determination module configured to compare the frame-delayed video signal and the input video signal to determine motion information in the input video signal;

a dark area determination module configured to determine the quantity of noise in the dark portion of the input video signal based on the motion information.

9. The video display apparatus according to claim 1, wherein the frequency separator comprises a low-pass filter.

10. The video display apparatus according to claim 1, wherein the first component of the input video signal is a low frequency component.

11. The video display apparatus according to claim 1, wherein the display module is a liquid crystal display.

12. The video display apparatus according to claim 1, wherein the display controller is configured to control the display module to display the corrected components of the input output video signal in strict accordance with the lighting value of backlight regions.

13. A video display method comprising:

calculating a lighting value for each of backlight regions based on an input video signal;

outputting the lighting value as numerical data to the backlight;

controlling backlight regions based on the lighting value;

setting a first signal correction coefficient based the lighting value;

separating the input video signal into a first component and second component based on frequency;

correcting the first component of the input video signal by multiplying the first component by the first signal correction coefficient;

obtaining a noise component coefficient indicating a quantity of noise in the input video signal;

setting a second signal correction coefficient based on at least the noise component coefficient and the first signal correction coefficient;

correcting a second component of the input video signal by multiplying the second component by the second signal correction coefficient; and controlling a display module to display the corrected components of the input video signal.

14. The method of claim 13, further comprising:

obtaining a high frequency emphasis coefficient and using the high frequency emphasis coefficient in setting the second signal correction coefficient.

15. The method of claim 13, wherein the noise component coefficient is calculated in a noise component coefficient calculator.

16. The method of claim 15, further comprising:

generating a histogram based on the input video signal, the histogram correlating luminance values with a percentage of a display screen occupied by each luminance value;

determining the quantity of noise in a dark portion of the input video signal is large when the histogram indicates a dark scene is depicted in the input video signal.

17. The method of claim 15, further comprising:

storing a frame-delayed video signal corresponding to a previous frame of the input video signal;

comparing the framed-delayed video signal and the input video signal to determine motion information in the input video signal;

determining the quantity of noise in a dark portion of the input signal is large when the motion information indicates the dark portion is a still image.

18. The method of claim 15, further comprising:

generating the input video signal from a compressed video signal;

obtaining information about the compression ratio of the compress video signal;

determining the quantity of noise in a dark portion of the input video signal is large when the information about the compression ratio indicates a high compression ratio.

* * * * *